United States Patent [19]

Baker, Jr.

[11] 3,967,868

[45] July 6, 1976

[54] STORAGE SYSTEM

[75] Inventor: Edward A. Baker, Jr., Birmingham, Mich.

[73] Assignee: E. Baker and Associates, Inc., Franklin, Mich.

[22] Filed: Feb. 14, 1975

[21] Appl. No.: 550,129

[52] U.S. Cl. ..... 312/201; 312/198; 312/250; 238/10 R

[51] Int. Cl.[2] ..... A47B 53/00

[58] Field of Search ..... 312/201, 198, 199, 250, 312/332; 238/10 F

[56] References Cited

UNITED STATES PATENTS

| | | | |
|---|---|---|---|
| 1,323,511 | 12/1919 | Welch | 312/250 |
| 1,694,528 | 12/1928 | Clarkson | 238/10 R |
| 1,858,086 | 5/1932 | House | 312/201 |
| 2,590,040 | 3/1952 | Rose | 238/10 F |
| 2,836,129 | 5/1958 | Jaeger | 238/10 F |
| 2,915,195 | 12/1959 | Crosby | 312/199 |
| 3,094,363 | 6/1963 | Fremstad et al. | 312/332 |
| 3,535,009 | 10/1970 | Cain | 312/199 |
| 3,567,299 | 3/1971 | Lundquist | 312/250 |
| 3,724,389 | 4/1973 | Greaves | 312/199 |
| 3,801,176 | 4/1973 | Higbee | 312/199 |

FOREIGN PATENTS OR APPLICATIONS

| | | | |
|---|---|---|---|
| 231,535 | 12/1958 | Australia | 312/199 |
| 1,262,305 | 4/1961 | France | 312/199 |
| 914,980 | 1/1963 | United Kingdom | 312/201 |

*Primary Examiner*—Paul R. Gilliam
*Assistant Examiner*—Victor N. Sakran
*Attorney, Agent, or Firm*—Harness, Dickey & Pierce

[57] ABSTRACT

A storage system comprising a plurality of generally aligned storage units, each of the units including at least two storage sections arranged in side-by-side relation, the units being supported for movement along a predetermined substantially linear path by means of a plurality of generally parallel arranged tracks, with one pair of tracks being associated with each of the storage sections, the tracks being relatively flexible so as to be adapted to be laid directly upon and contiguously conform to a relatively irregular support surface; and a base structure on each of the storage sections and provided with pairs of spaced rollers adapted to ride upon and traverse mating pairs of tracks, the storage sections of each of the units being connected together but acting individually with their mating tracks and independently of the adjacent tracks as the storage units traverse the tracks along the aforesaid path.

22 Claims, 7 Drawing Figures

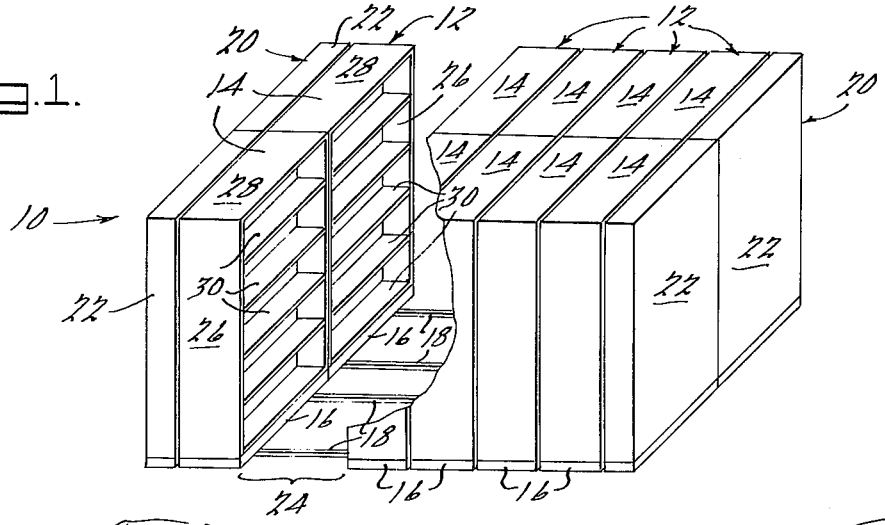
Fig. 1.
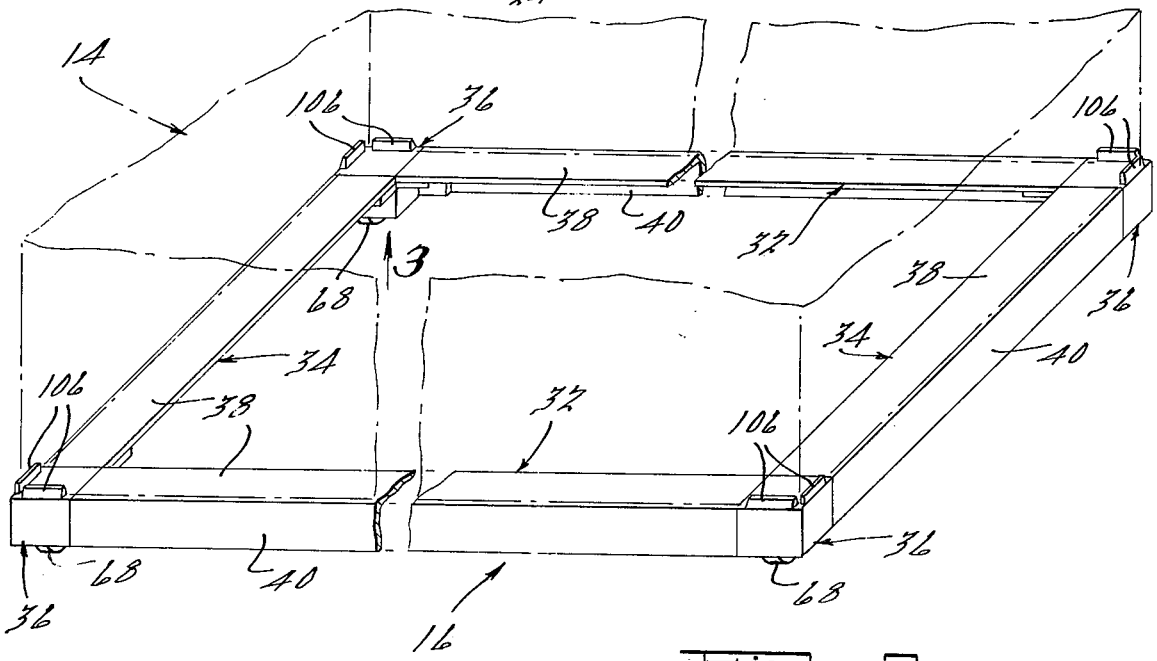
Fig. 2.
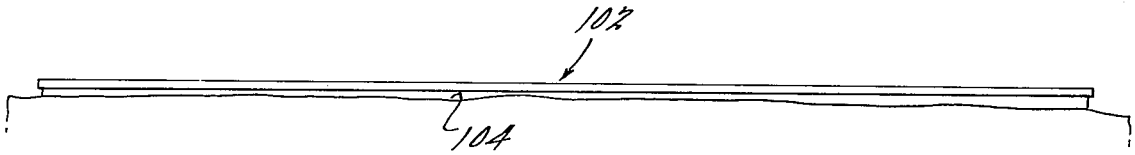
Fig. 7.
Fig. 6.
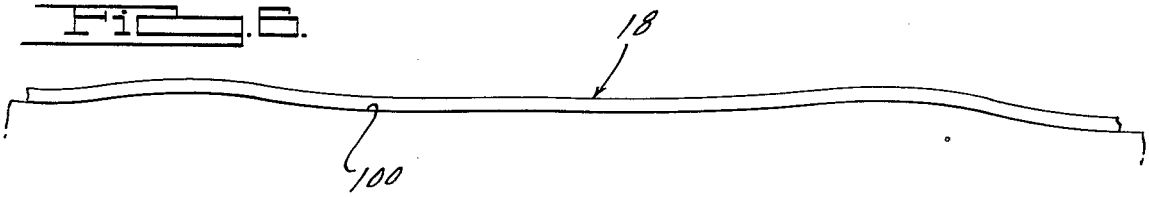

STORAGE SYSTEM

BACKGROUND OF THE INVENTION

Various types of high density storage systems have heretofore been known and used in the prior art wherein a plurality of individual storage units are movable in a manner so as to provide for convenient access to the various storage sections, yet minimize to the extreme the space requirements for the overall system. Typically such storage systems consist of rows of storage sections, for example, sections of storage shelves, which are supported upon a common base and movable by means of suitable rollers or the like upon two or more spaced parallel tracks. The length of the tracks is typically approximately equal to the total dimension of the various storage units when placed directly adjacent one another plus the width of an access aisleway along which a person can have access to the shelf sections. Such prior art storage arrangements are shown, for example, in U.S. Pat. Nos. 2,166,704; 2,547,368; 2,915,195; 3,080,204; 3,168,361; 3,427,085; 3,535,009; 3,566,802; 3,575,479 3,640,595; 3,724,389; 3,801,176; and 3,829,189.

While the various patents noted above disclose storage systems which are analogous to the present invention, such prior art structures have been subject to the objectionable criticism in that they have used relatively rigid track elements which necessitated extremely accurate leveling in order to provide for reasonably effortless movement of the storage units. Such leveling has required that the tracks be mounted directly upon an extremely level support surface or floor, or that some means be provided interjacent the surface of an irregular floor and the tracks to assure for accurate leveling thereof. It has been found that even small variations in out of levelness of the tracks results in a significant increase in the effort required to move the storage units therealong. Consequently, significant time and effort has been required to assure for track levelness in order to provide for efficient operation of the prior art storage systems. This, of course, results in an objectionable decrease in the economies of production, installation, maintenance, etc.

The present invention is directed toward a new and improved storage system which is generally related to the systems shown in the aforesaid prior art patents; however, the storage system of the present invention is intended to overcome the objectionable criticism of similar type units in the prior art. In particular, the storage system of the present invention contemplates the use of relatively flexible, as opposed to rigid, tracks which are intended to be mounted directly upon and conform to their respective supporting surfaces over the entire length of any given application, regardless of whether or not such supporting surface may have irregularities therein. By virtue of the compliant nature of the track design, such tracks may be laid on virtually any type of support surface that is normally encountered in application sites without requiring ancillary anchoring means, leveling or otherwise modifying the supporting surfaces. In addition to the above, the storage system of the present invention is developed on a modular unit concept. That is, each of the storage units consists of two or more storage sections, with each of the sections being carried on an individual base. The various sections of each unit are interconnected in a manner so as to provide for relatively limited movement or articulation between the sections and the respective bases thereof so that even though a particular storage unit is designed to move as a single entity, the fact that each storage section of the unit is carried on a complete and non-dependent movable base allows considerable freedom in application while insuring acceptable and predictable performance levels. Thus, as a storage unit is moved, the individual bases act independently with their mating tracks and are not influenced by the adjacent or related tracks. The particular design of the tracks in the storage system of the present invention is such that the wheels or rollers of each of the track section bases are held in positive relationship to one another. Toward this end, the track design provides a V-groove that allows only line contact between the wheel tread edges and the track surface, as well as providing restriction and/or limitation to the rolling path by virtue of the inclined surfaces of the converging sides of the V-shaped grooves within which the wheels traverse. In addition, the wheels of each of the storage section bases are allowed to "float" on their respective axles, whereby to insure optimum wheel to track alignment, as will hereinafter be described in detail.

SUMMARY OF THE INVENTION

It is accordingly a general object of the present invention to provide a new and improved high density storage system.

It is a more particular object of the present invention to provide a new and improved storage system which obviates the need for providing accurately leveled tracks and hence permits installation on relatively irregular support surfaces.

It is another object of the present invention to provide a new and improved storage system wherein the tracks require virtually no leveling, fastening or anchoring and can be placed on any reasonable and normally encountered support surface.

It is a related object of the present invention to provide a storage system of the above described type wherein the tracks present a relatively low profile which can be negotiated easily and safely by pedestrians and/or vehicles.

It is yet another object of the present invention to provide a new and improved storage system, as above described, wherein each storage unit consists of two or more storage sections having individual bases that are interconnected so as to allow relative movement or articulation between the storage sections.

It is a further object of the present invention to provide a new and improved storage system of the high density type wherein the bases of the respective storage sections are fabricated with corner castings adapted to support associated rollers or wheels in a manner so as to provide for floating movement of the wheels as they traverse their mating tracks and hence provide for reasonably effortless movement of the storage units.

It is yet another object of the present invention to provide a new and improved storage system that will find universality of application and by virtue of having a large number of common components, will minimize inventory and replacement costs to the extreme.

It is another object of the present invention to provide a new and improved storage system, as above described, that is of a relatively simple and straight forward design and hence will have a long and effective operational life.

Other objects and advantages of the present invention will become apparent from the following detailed description taken in conjunction with the accompanying drawings.

BRIEF DESCRIPTION OF THE DRAWINGS

FIG. 1 is an elevated perspective view, partially broken away, of a typical installation of a storage system incorporating the principles of the present invention;

FIG. 2 is an elevated perspective view, partially broken away and partially in phantom, of one of the individual bases of the storage sections incorporated in the storage system illustrated in FIG. 1;

FIG. 6 is a schematic representation of a typical installation of one of the tracks incorporated in the storage system of the present invention, and FIG. 7 is a schematic representation similar to FIG. 6 of a prior art type track arrangement.

DESCRIPTION OF A PREFERRED EMBODIMENT

Figure 3:
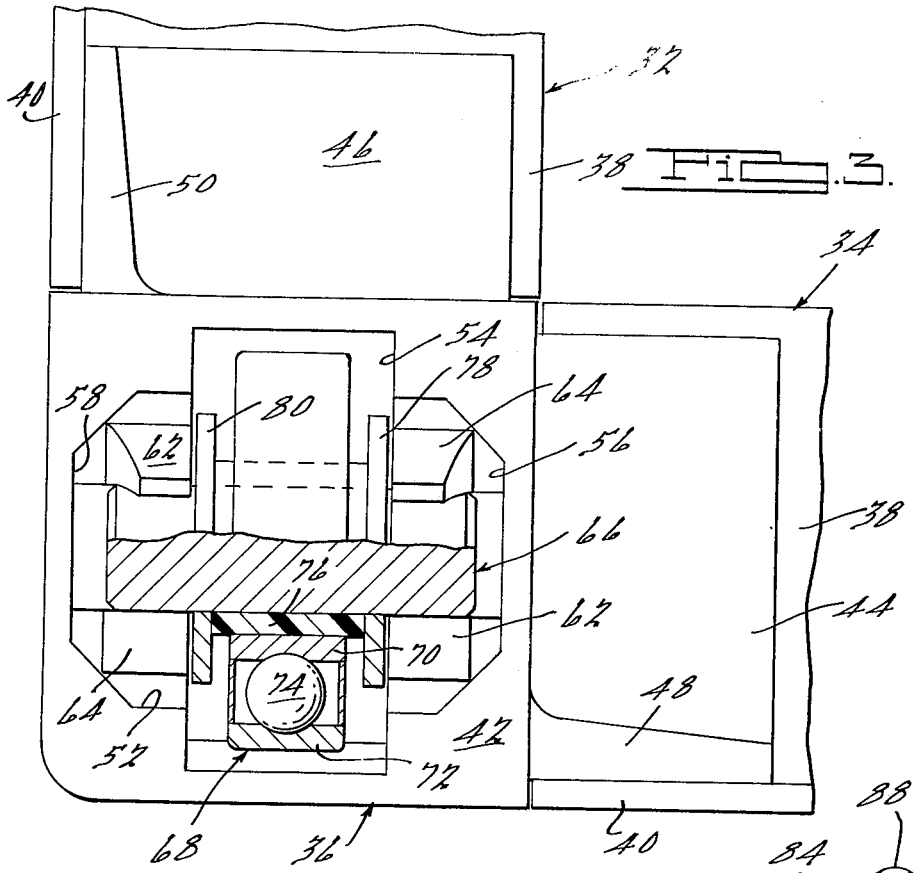
FIG. 3 is an enlarged fragmentary bottom elevational view, partially in section, taken in the direction of the arrow 3 of FIG. 2.

Referring now in detail to the drawings and in particular to FIG. 1 thereof, a storage system 10, in accordance with one preferred embodiment of the present invention, is shown as comprising a plurality of movable storage units, generally designated by the numeral 12, which are arranged in generally aligned relationship. Each of the storage units comprises a pair of side-by-side storage or shelf sections 14, with each of the sections 14 being provided with its own individual support base 16. The storage units 12 are adapted to be movable along a generally linear path upon a plurality of tracks, generally designated 18, with two of such tracks 18 being matingly associated with each of the bases 16 of the storage units 12, as illustrated in FIG. 1. By way of example, the storage system 10 is also shown as being provided with a pair of relatively fixed storage units, generally designated 20, which are located at the opposite ends of the movable units 12 and include storage or shelf sections 22, as illustrated. As will be apparent, the fixed units 20 are provided with relatively fixed support bases and hence the tracks 18 extend only between the confronting sides of the fixed storage units 20. The particular length of the tracks 18 is equal to the width of a typical aisleway or walkway, designated by the numeral 24 in FIG. 1, plus the sum of the overall dimension of the plurality of movable storage units 12 when the units 12 are located directly adjacent one another. By way of example, each of the shelf sections 14 comprises a pair of spaced apart, vertically extending sides, an upper or top portion 28 and a plurality of vertically spaced horizontally extending shelves 30. As will be appreciated by those skilled in the art, at such time as it is desired to provide access to one of the movable storage units 12, the units 12 there adjacent are moved or traversed along the tracks 18 such that the appropriate access aisleway 24 is provided adjacent the unit 12 to which access is desired.

Referring now in detail to the construction of the shelf or storage sections 14 and in particular to the bases 16 thereof, as best seen in FIG. 2, the details of one of the bases 16 is illustrated, with such base being representative of all of the bases associated with the movable storage sections 14. As illustrated, the base(s) 16 comprises a pair of longitudinally extending spaced parallel frame members 32 between which a pair of transversely disposed spaced parallel frame members 34 extend. The adjacent ends of the frame members 32, 34 are interconnected by means of a plurality of four corner elements, generally designated by the numeral 36. The frame members 32, 34 comprise generally right angle channels consisting of top or upper side portions 38 and generally vertical side portions 40, with the members 32, 34 being oriented such that the side portions 40 thereof are oriented on the exterior or exposed sides of the bases 16.

Figure 4:
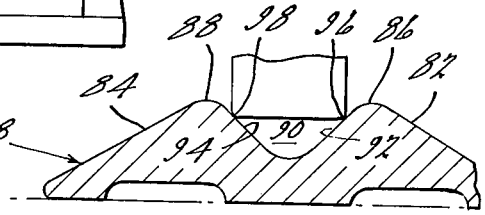
FIG. 4 is a transverse cross sectional view of the structure shown in FIG. 3.

As best seen in FIGS. 3 and 4, the corner elements 36 of each of the bases 16 are generally identical in construction and operation and consist of a one-piece casting or body 42, fabricated, for example, of suitable metallic alloy, such as aluminum. The body 42 of each of the bases 16 is formed with a pair of generally horizontally extending flanges 44, 46 that are arranged at right angles to one another and with a pair of vertical flanges 48, 50 that extend downwardly from the adjacent of the flanges 44, 46. The flanges 44–50 are recessed relative to the exposed outer sides of the body 42 and are adapted to be received within the interior sides of the longitudinal and transverse frame members 32, 34 in a manner best shown in FIGS. 3 and 4. Suitable means such as screws, bolts or other appropriate fastening means (not shown) may be utilized for fixedly securing the flanges 44–50 to the respective end portions of the frame members 32, 34, whereby to provide the relatively unitized base assembly shown in FIG. 2.

The underside of each of the corner elements 36 is formed with a recessed area, generally designated by the numeral 52. The recessed area 52 comprises a central portion 54 and opposed generally aligned end portions 56, 58, as best seen in FIG. 3. Disposed within each of the end portions 56, 58 of the recessed areas 52 is a pair of bifurcated deformable integral fingers 60, 62 which define semi-circular recesses 64 therebetween. The recesses 64 are adapted to receive the opposite ends of an elongated cylindrically shaped axle or shaft 66, with the lowermost or terminal ends of the fingers 60, 62 being deformed or "staked" inwardly adjacent the underside of the axle 66, whereby to retain the same within the recesses 64 defined thereby. Disposed centrally of the axle 66 between the pairs of fingers 60, 62 is a rotatable wheel or roller, generally designated by the numeral 68. As shown in FIGS. 3 and 4, the rollers 68 comprise inner and outer races 70 and 72, respectively, between which a plurality of ball bearing anti-friction elements 74 are disposed, whereby to provide for low friction rotational movement between the races 70 and 72. Interposed between the outer periphery of the axle 66 and the inner periphery of the inner race 70 is a sleeve bushing 76 which is preferably fabricated of a suitable anti-friction polymeric material, such as a suitable wear resistant Nylon. A pair of thrust washers 78, 80 are interposed between the confronting sides of the bifurcated fingers 60, 62 and the ends of the sleeve bushing 76, and it will be noted that an axial spacing is provided between the sides of the washers 78, 80 and the adjacent sides of the roller or wheel 68, whereby to permit the wheel 68 to move a limited degree axially of the axle 66 and hence "float" relative to the associated corner element 36 so as to accommodate for slightly out of "parallel" tracks 18.

Figure 5:
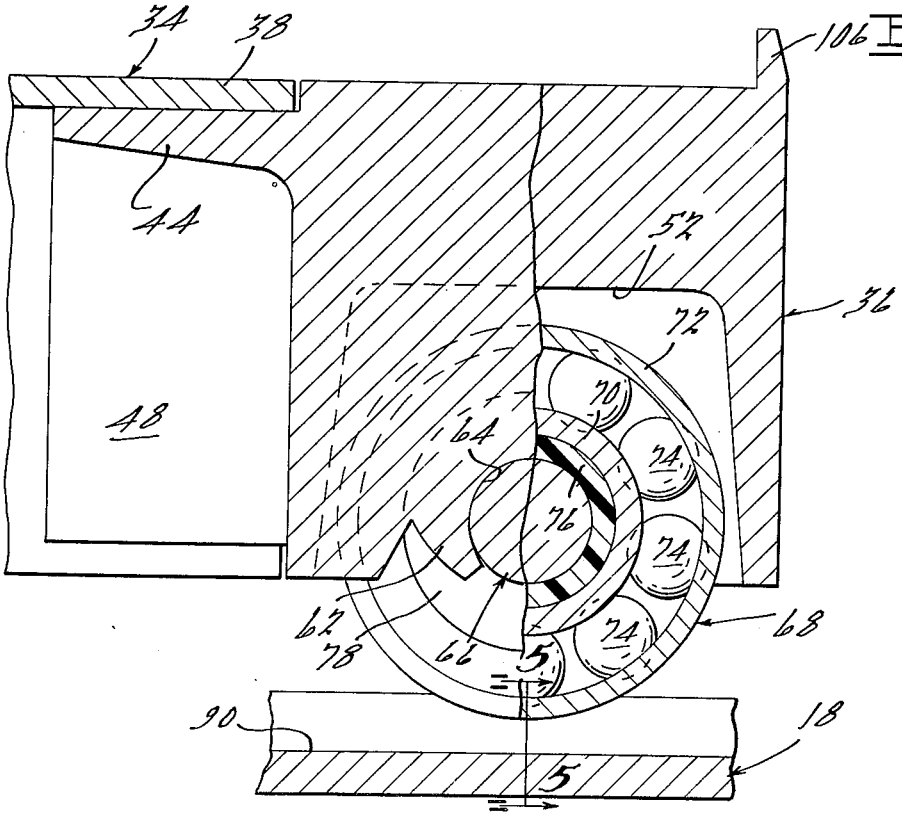
FIG. 5 is a transverse cross sectional view taken substantially along the line 5—5 of FIG. 4.

In accordance with one of the important features of the present invention, the tracks 18 upon which the wheels or rollers 68 of the bases 16 are adapted to traverse are designed so as to be relatively flexible or compliant and as such are fabricated of a relatively rigid, yet bendable material, such as extruded aluminum. Accordingly, the tracks 18 are adapted to be mounted directly upon an associated support surface, regardless of whether or not such surface is relatively irregular or out of level and without requiring any specific leveling of such surface preparatory to mounting of the tracks 18 thereon. FIG. 5 illustrates a typical cross sectional shape of the tracks 18 incorporated in the present invention wherein it will be seen that the tracks comprise upwardly inclined and converging top surfaces 82, 84 which terminate in generally arcuate uppermost portions 86, 88 respectively. Disposed centrally of the tracks 18 is an elongated V-shaped groove or recessed area 90 which is defined by downwardly inclined and converging surfaces 92 and 94. The cross sectional shape of the tracks 18 is correlated with the axial dimension of the rollers 68 such that the rollers will travel interiorly of the V-shaped recessed area 90 and will contact or engage the surfaces 92, 94 in "line contact", as indicated at 96 and 98 in FIG. 5. By virtue of this line contact between the lateral side edges of the wheels or rollers 68 and the tracks 18, frictional resistance to such rolling movement will be minimized to the extreme. It is contemplated that if such resistance is to be reduced even further, elongated inserts fabricated, for example, of a suitable wear resistant Nylon, Teflon, Delrin, etc. may be embedded in the surfaces 92, 94 such that the lateral side edges of the rollers or wheels 68 will be in engagement therewith. Another design feature of the tracks 18 resides in the fact that they present a relatively low profile so as to not present a hazard to persons or vehicles moving along the aisleways 24 seeking access to the shelf or storage sections 14.

As previously mentioned, the shape and construction of the tracks 18 is such that they are relatively flexible or deformable and therefore are adapted to conform with the supporting surface upon which they are mounted even though such surface may be of a relatively irregular or out of level character. Toward this end, reference is made to FIG. 6 wherein the track 18 is schematically illustrated as being mounted upon a relatively irregular support surface 100. While the irregularities and out of levelness of the support surface 100 is shown in a somewhat exaggerated manner, it is evident that the track 18 is intended to conform to such irregularities so as to obviate the need and expense of providing an extremely accurately level surface or providing ancillary support means between an irregular support surface and the relatively rigid track sections heretofore used in the prior art. By way of comparison, such a rigid track section is identified by the numeral 102 in FIG. 7 and is shown operatively mounted above a relatively irregular support surface 104 and having suitable support means interposed therebetween in order to provide adequate support for the rigid track member 102. As will be appreciated by those skilled in the art, one of the significant reasons that the tracks 18 may be used even on relatively irregular or out of level surfaces resides in the fact that in the storage system 10, the various storage units 12, and in particular, the individual bases 16 thereof, move over a relatively short portion of the total length of the tracks 18 and thus the flexible and compliant nature of the track requires only that out of levelness and undulations over a limited area be traversed by any one base.

With reference now to the overall operation of the storage system 10 of the present invention, it will be seen that the respective storage or shelf sections 14 are mounted directly upon the upper side of the bases 16 of each of the storage units and toward this end suitable support means, such as upwardly extending shoulders 106 may be provided on each of the corner elements 36 in order to assure proper orientation and positioning of the shelf sections 14 on the bases 16. At such time as it is desired to obtain access to one of the particular shelf sections 14 of a particular storage unit 12, the remaining of the storage units 12 between such unit to which access is desired and the adjacentmost of the fixed or end storage units 20 may be conveniently biased or traversed along the tracks 18, whereby to provide the desired access aisleway 24. By virtue of the fact that only a single aisleway 24 is required to provide access to a multiplicity of movable storage units 12, extremely high density storage is achieved in a manner well known in the art, and such effortless movement of the various storage units 12 is achieved as a result of the many features embodied in the present invention. In particular, by virtue of the fact that the rollers 68 are adapted to float by moving axially of the respective axles and associated corner elements 36 of the storage section bases 16, such rollers 68 will be guided within the V-shaped grooves 90 even though the tracks 18 may be, to a limited degree, somewhat out of parallel. In addition, the line contact between the side edges of the rollers 68 and the surfaces 92, 94 of the tracks 18 minimizes rolling friction to the extreme. In a preferred construction of the present invention, the bases 16 are of a relatively flexible character, i.e., non-rigid, so that even though the tracks 18 are mounted on irregular support surfaces, even load distribution will be maintained on all four rollers of each of the bases 16. Such flexibility of the bases 16 may be achieved through non-rigid interconnection of the frame members 32, 34 with the adjacent corner elements 36, as will be apparent. Importantly, movement of the storage units 12 is achieved in a relatively effortless manner by virtue of the fact that the bases 16 of each of the shelf sections 14 are independent of one another and may act individually with their respective or mating tracks 18 without influence of the adjacent bases 16 and their respective mating tracks 18. Thus, even though one of the bases 16 of a particular storage unit 12 traverses a relatively irregular portion of its mating track 18, the remaining base or bases 16 of the other shelf sections 14 of the particular storage unit 12 will not be influenced by such irregularity, with the result that the overall effort required to move the subject shelf unit is minimized to the extreme.

Other features of the present invention will be seen from the fact that the various corner elements 36 are interchangeable, whereby to minimize inventory and manufacturing costs to the extreme. In addition, it is contemplated that the corner elements 36 may be interchangeable with relatively fixed elements, i.e., corner elements which are not provided with the rollers 68, whereby to provide for universality of use of the various frame members 32, 34 for either fixed or movable bases. Also, it will be seen that the actual structural members of the storage units 12, and in particular the frame members 32, 34 and corner elements 36 of the bases 16 thereof, are of a minimum structural size, whereby to provide a minimum amount of dead weight. Finally, universality of application will be seen in that various types of storage devices may be utilized with each of the bases 16, i.e., open shelf units, closed shelf units, file units, etc., and due to the extreme simplicity of construction and operation, the storage system 10 will be seen to be economical to manufacture, will require a minimum amount of maintenance and have a long and effective operational life. Toward this end, it will be noted that the corner elements 36 may be rotated or oriented 90° from their respective positions shown in the drawings herein so as to render the storage units 12 capable of moving in a direction perpendicular or at right angles to the direction shown in FIG. 1 of the drawings. Thus, assuming that the tracks 18 are properly oriented so as to extend parallel to the direction of desired movement, the corner elements 36 may be used on bases 16 that move in the manner and direction depicted in FIG. 1, as well as in a direction perpendicular thereto, without departing from the scope and fair meaning of the claims appended hereto.

While it will be apparent that the preferred embodiment illustrated herein is well calculated to fulfill the objects above stated, it will be appreciated that the present invention is susceptible to modification, variation and change without departing from the scope of the invention.

I claim:

1. A storage system including at least one storage unit, means supporting said unit for movement between spaced apart locations and including:

a base structure having first and second pairs of rollers, a pair of relatively flexible track members matingly associated with said storage unit and adapted to have said rollers of the base structure supported upon and guided thereby, said track members being operatively mounted directly upon and being compliant with and conformable to a relatively irregular surface.

2. A storage system as set forth in claim 1 which includes a plurality of storage units each comprising at least two storage sections arranged in side-by-side relation, a separate base structure and first and second pairs of rollers for each of said storage sections, and means operatively connecting said storage sections together to form said storage unit, with said connecting means providing for limited independent movement of said sections as said storage sections traverse said tracks.

3. A storage system as set forth in claim 1 wherein said track members are relatively flexible and compliant so as to conform with a relatively irregular support surface when mounted thereon.

4. A storage system as set forth in claim 1 wherein said rollers are movable relative to said base so as to ride along and be guided by said tracks even though said tracks may be to a limited degree out of parallel.

5. A storage system as set forth in claim 2 wherein each of said base structures is generally rectangular in shape and comprises a pair of spaced parallel side members, a pair of spaced parallel end members extending between said side members and a plurality of four corner elements connecting the adjacent ends of said side and end members.

6. A storage system as set forth in claim 5 wherein said rollers are mounted one in each of said corner elements.

7. A storage system as set forth in claim 6 wherein the underside of each of said corner elements is recessed to receive a roller axle having the associated of said rollers mounted thereon, which includes anti-friction means interposed between said axles and the associated of said rollers, and which includes means providing for limited axial displacement of said rollers relative to said axles to permit said roller to float relative to said corner element.

8. A storage system as set forth in claim 3 wherein said tracks define a central V-shaped groove co-extensive of the upper sides thereof.

9. A storage system as set forth in claim 8 wherein the roller edges engage said V-shaped groove in substantially line contact.

10. A storage system as set forth in claim 2 wherein said base structures are relatively flexible and thereby maintain said rollers in mating engagement with said track members even though said track members are operatively mounted on an irregular support surface.

11. The invention as set forth in claim 1 wherein said base structure comprises side and end members, and a plurality of four corner elements having said rollers mounted therein, said corner elements being selectively positionable in a first orientation at the adjacent ends of said side and end members whereby to render said base structure operable to roll in a first direction, and being positionable in a second orientation to render said base structure operable to roll in a second direction at right angles to said first direction.

12. The invention as set forth in claim 1 wherein said base structure comprises a plurality of four side sections and four corner members, each of said corner members having a roller element supported directly upon one of said tracks and first and second mounting portions, one of said mounting portions of each corner member being located parallel to the axis of rotation of the associated roller element and the other of said mounting portions being located generally perpendicular to said axis, said mounting portions being interchangeably engageable with the ends of selected of said base structure side sections whereby the axes of rotation of said roller elements may be oriented parallel or perpendicular to the front and back of said unit.

13. In combination in a storage system, a plurality of generally aligned and individually movable storage units, each of said units including at least two storage sections arranged in side-by-side relation, support means for supporting said storage units for movement along a predetermined substantially linear path and including a plurality of generally parallel arranged tracks, with one pair of said plurality of tracks being associated with each of said storage sections, said tracks being relatively flexible so as to be contiguously conformable with a relatively irregular support surface when said tracks are laid directly on said surface, said tracks also being at least as great in length as the sum of the dimension of a single access aisleway and total dimension of said units when placed directly adjacent one another, a base structure on each of said storage sections and comprising pairs of spaced rollers riding directly upon and supported by the associated of said pairs of tracks, said storage sections of each of said units being connected together and acting individually with their mating tracks and independently of the adjacent tracks as said storage units traverse said tracks.

14. The combination as set forth in claim 13 wherein said rollers are movable relative to the associated of said base structures so as to ride along and be guided by said tracks even though said tracks may be to a limited degree out of parallel.

15. The combination as set forth in claim 13 wherein each of said base structures is generally rectangular in shape and comprises a pair of spaced parallel side members, a pair of spaced parallel end members extending between said side members and a plurality of four corner elements connecting the adjacent ends of said side and end members.

16. The combination as set forth in claim 15 wherein said rollers are mounted one in each of said corner elements.

17. The combination as set forth in claim 16 wherein the underside of each of said corner elements is recessed to receive a roller axle having the associated of said rollers mounted thereon, which includes anti-friction means interposed between said axles and the associated of said rollers, and which includes means providing for limited axial displacement of said rollers relative to said axles to permit said roller to float relative to said corner element.

18. The combination as set forth in claim 13 wherein said tracks define a central V-shaped groove co-extensive of the upper sides thereof.

19. The combination as set forth in claim 18 wherein the roller edges engage said V-shaped groove in substantially line contact.

20. The combination as set forth in claim 13 wherein said base structures are relatively flexible and thereby maintain said rollers in mating engagement with said track members even though said track members are operatively mounted on an irregular support surface.

21. The combination as set forth in claim 16 wherein said corner elements comprise castings of a lightweight metallic alloy and which include retaining means on the upper side thereof for retaining said storage sections properly oriented on said base structure.

22. The combination as set forth in claim 21 wherein said retaining means comprise upstanding integral extending shoulders formed on said corner elements.

* * * * *